US006026990A

United States Patent [19]

Brunswig

[11] Patent Number: 6,026,990

[45] Date of Patent: Feb. 22, 2000

[54] HOLDER FOR AEROSOL DEFENSE SPRAY DEVICE

[76] Inventor: James A. Brunswig, P.O. Box 154, Haigler, Nebr. 69030

[21] Appl. No.: 08/941,915

[22] Filed: Oct. 1, 1997

Related U.S. Application Data

[62] Division of application No. 08/519,915, Aug. 28, 1995.

[51] Int. Cl.[7] ..... B67D 5/13

[52] U.S. Cl. ..... 222/153.13; 222/530

[58] Field of Search ..... 222/113, 3, 162, 222/153.13, 153.14, 112, 192, 523, 527, 530, 325

[56] References Cited

U.S. PATENT DOCUMENTS

| | | | |
|---|---|---|---|
| 1,662,067 | 3/1928 | Lefever | 222/79 |
| 3,415,420 | 12/1968 | White | 222/79 |
| 4,058,921 | 11/1977 | Mason | 222/79 |
| 5,307,249 | 4/1994 | Vanwynsberghe | 222/162 |
| 5,397,029 | 3/1995 | West | 222/79 |
| 5,671,559 | 9/1997 | Ludaesher et al. | 222/79 |
| 5,673,819 | 10/1997 | Brunswig | 222/153.13 |

*Primary Examiner*—Philippe Derakshani
*Attorney, Agent, or Firm*—Gregory J. Nelson

[57] ABSTRACT

A holder for an aerosol chemical defense spray. The holder may take different forms and has the appearance of or is part of another device such as a pager, flashlight, baton or handgun. In a preferred embodiment, the aerosol canister is housed in a holder which is attached to a conventional electronic beeper. The holder is readily accessible and does not alert bystanders that the wearer is carrying a defense spray. The various embodiments of the invention include a safety mechanism to prevent the inadvertent or accidental discharge of the chemical spray.

3 Claims, 8 Drawing Sheets

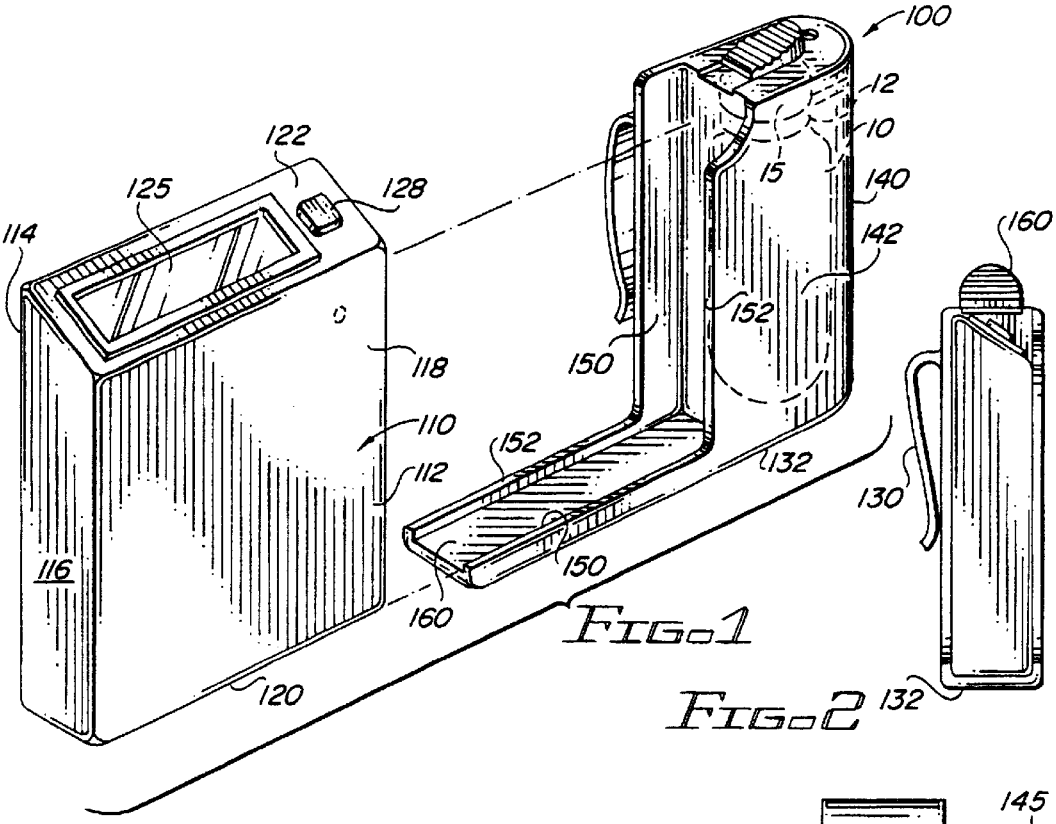
FIG. 1
FIG. 2
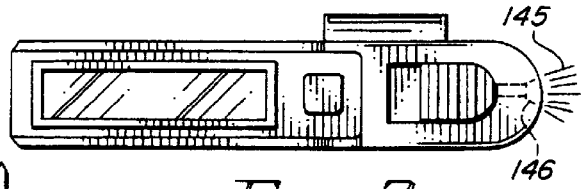
FIG. 3
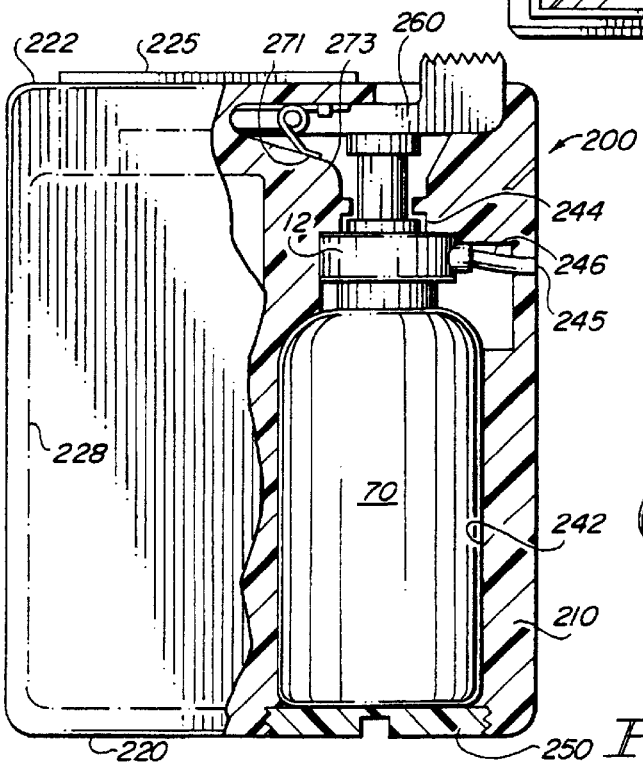
FIG. 4
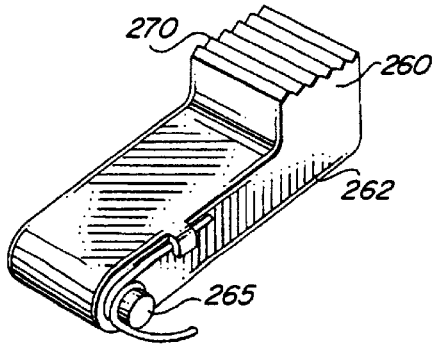
FIG. 7

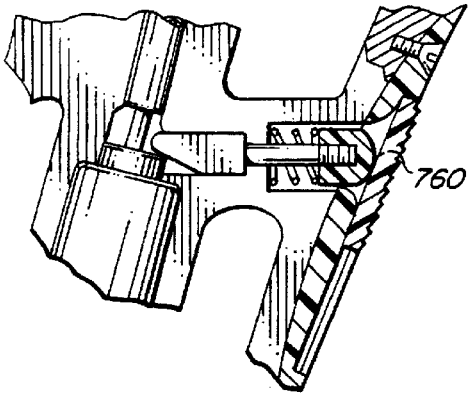
FIG. 31A
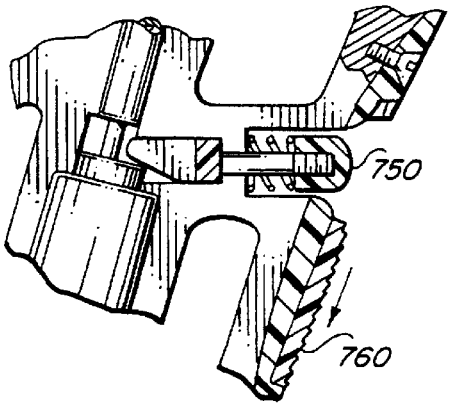
FIG. 31B
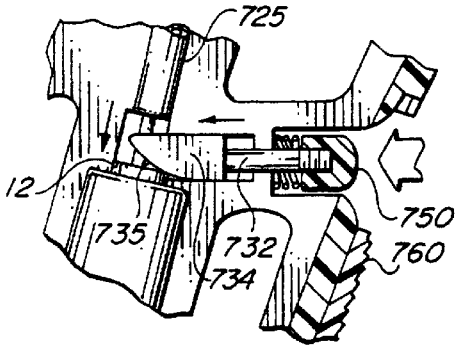
FIG. 31C
FIG. 32
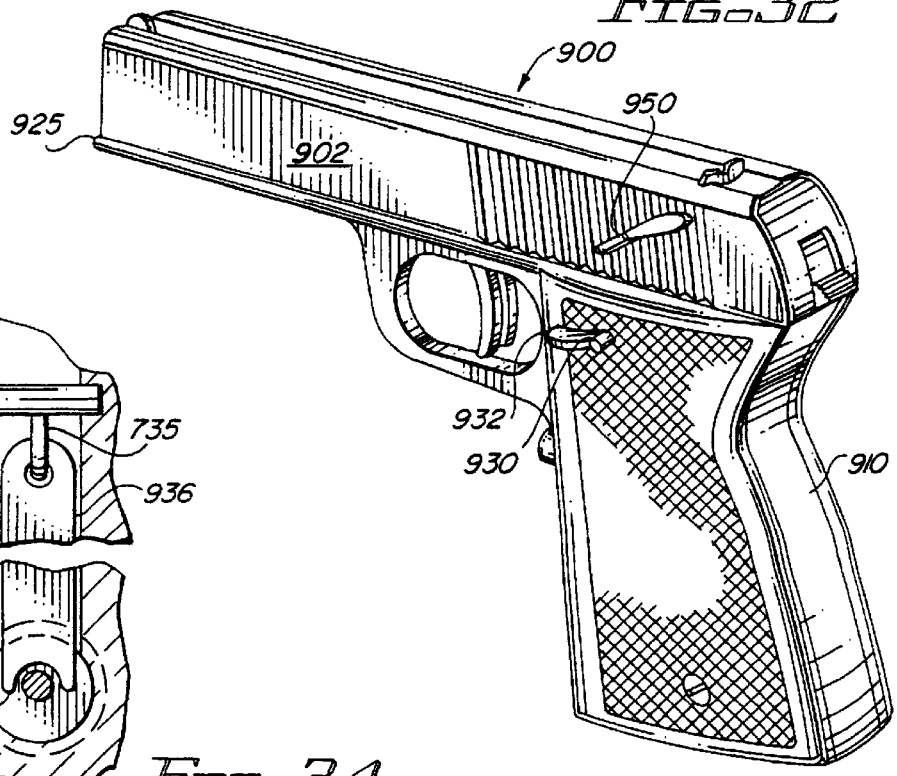
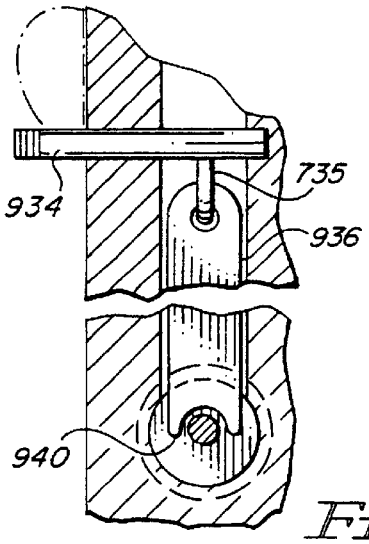
FIG. 34

HOLDER FOR AEROSOL DEFENSE SPRAY DEVICE

This application is a divisional of application Ser. No. 08/519,915 filed on Aug. 28, 1995.

BACKGROUND OF THE INVENTION

Field of the Invention

The present invention relates to a holder and more particularly relates to a holder for aerosol containers of the type which contain and dispense deterrent chemical sprays.

Chemical aerosol sprays have gained popularity in recent years as personal security devices. These devices can be easily carried by the user in a pocket or handbag. Generally, the aerosol is contained in a cartridge or canister which is grasped and, when actuated, will discharge an aerosol chemical spray to deter an attacker or assailant.

Various types of deterrent chemicals are commercially available in aerosol form as personal defense products and one of the more popular is a capsicum or pepper-based composition. There are various problems which may occur attendant to the use of aerosol containers and particularly those such as personal defense products. Aerosol products of this type must be convenient to use so that the individual can carry the dispenser in a manner so that the aerosol device can be quickly and easily retrieved and actuated in cases of emergency. It is also necessary to protect the aerosol canister so that it is not unintentionally or inadvertently actuated.

Accordingly, there exists a need for a holder for aerosol containers which will facilitate the convenient retrieval and use of personal defense sprays.

The present invention provides holders of various types which are adapted to receive the aerosol container so the aerosol container can be quickly retrieved and oriented with the discharge nozzle properly aimed in the direction of a potential assailant or attacker.

Accordingly, it is a broad object of the present invention to provide various types of holders for aerosol chemical sprays which holders are configured as or have the appearance or are an attachment to another device such as a pager, flashlight, police baton or handgun.

SUMMARY OF THE INVENTION

Briefly, in accordance with the present invention, a holder for an aerosol chemical spray device is provided which holder is part of or a component of another device such as a pager, flashlight, baton or handgun. In this way, the aerosol spray is convenient and readily accessible for use. In a preferred embodiment of the present invention, the aerosol canister is housed in a holder which is detachably secured to a conventional paging or "beeper" device. When the paging device is worn on the belt of a user, the holder may be easily grasped and retrieved for use. The holder has the appearance of a portion of the pager and therefore does not unnecessarily alert bystanders that the wearer is carrying an aerosol personal defense spray device.

Similarly, the aerosol spray canister may be housed within the structure of a flashlight having a discharge adapted to be directed in the direction of the beam of light. In other embodiments, the aerosol canister may be housed within a chamber of a police-type baton to provide the police officer with the added security and defense provided by of the deterrent spray. In yet another embodiment, the canister or a reservoir for a chemical may be housed within a portion of the handgun to allow the user to discharge the non-lethal spray by directing the barrel of the handgun towards a target. This allows the user to use a non-deadly deterrent force while also permitting the firearm to be fired if such is necessary. The various embodiments include a safety device to prevent the inadvertent or accidental discharge of the chemical spray.

BRIEF DESCRIPTION OF THE DRAWINGS

The above and other objects and advantages of the present invention will be more fully understood and appreciated from the following description, claims and drawings in which:

FIG. 1 is a perspective view of a deterrent spray holder shown as an attachment to a conventional pager;

FIG. 2 is a side view of the pager and holder of FIG. 1;

FIG. 3 is a top view of the pager and holder of FIG. 1;

FIG. 4 is an elevational view of a paging device partly broken away to show the internal chamber for receiving an aerosol canister integral with the pager;

FIG. 7 is a perspective view of the actuator lever of the device shown in FIGS. 4 through 6;

FIG. 31A to 31C sequentially illustrate the actuation of the defense spray canister shown in FIGS. 29 and 30;

FIG. 32 is a perspective view of yet another embodiment of the present invention in which deterrent spray is contained within the frame of a conventional handgun;

FIG. 34 is a sectional view taken along line 34—34 of FIG. 33;

Figure 5:
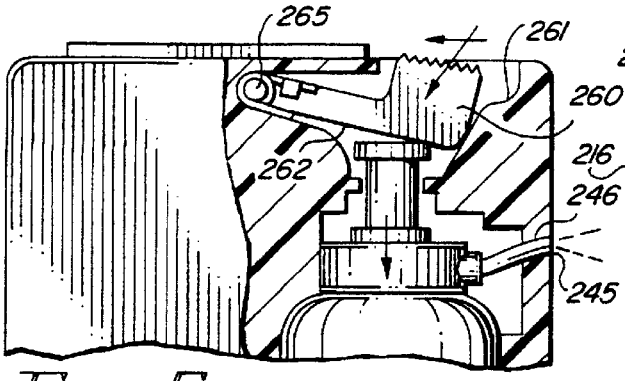
FIG. 5 is an enlarged detail view of the portion of the housing of the device of FIG. 4 partly broken away showing the actuator and safety lock device.

Turning to the drawings, a preferred embodiment of the present invention is shown in FIGS. 1 to 3.

Throughout the following description the same numerals are used to identify the same or similar parts or elements. FIGS. 1 through 3 illustrate an embodiment of the holder of the present invention generally designated by the numeral 100 which is adapted to be removably detached to a paging or beeper device 110. The paging or beeper device 110 is conventional and may be of any type commercially available. The beeper 110 has a generally rectangular body with front wall 112, rear wall 114, opposite sides 116 and 118, bottom 120. Top surface 122 is provided with a conventional digital display 125 and actuator button 128. The beeper is provided with a spring clip 130 which can be attached to the belt or trouser top of the user so the beeper is in a convenient position for use. The above-described components are conventional and comprise no part of the present invention.

The holder 100 consists of a generally elongate body 140 defining internal chamber 142 adapted to receive an aerosol canister 10. The aerosol canister 10 is of conventional design with a generally cylindrical cartridge having a valve 12 at the upper end which when depressed will release the pressurized contents, such as a pepper-based defense spray. The aerosol spray is released at a discharge nozzle 15. Aerosol containers of this general type are well known. The aerosol canister is inserted into the body chamber 142 by removing the bottom slide plate 132. When positioned within the housing, the discharge of the canister communicates via passageway 146 with orifice 145 as best seen in FIG. 3.

The holder 100 is detachably securable to the conventional beeper 110 and, when the two components are assembled, have the overall appearance of a beeper. Accordingly, the housing 140 is provided with a pair of spaced-apart flanges 150 and 152 which are adapted to engage the lower edge of the front and rear 112 and 114 of the beeper device. A bottom tray-like extension 160 snugly receives the bottom surface 120 of the pager. When assembled, the pager 110 and the holder 100 may be secured to the belt of the user at clip 130 and the holder easily retrieved and separated for use by sliding it laterally with respect to the beeper.

In order to actuate the device, the actuator button 160, which projects from the top of the housing 142, is depressed to bring the actuator into engagement with the nozzle 15 causing the valve 12 to release the contents of the aerosol container through the passageway 146 and discharge nozzle 145 as seen in FIG. 3.

Figure 6:
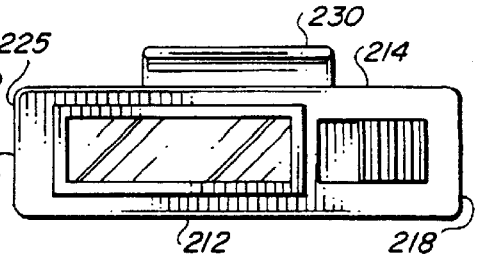
FIG. 6 is a top view of the device shown in FIG. 4.

FIGS. 5 through 7 show a modified version of an aerosol holder generally designated by the numeral 200. Embodiment 200 is similar to that shown in FIGS. 1 to 3 with the exception the aerosol cartridge is received within a compartment integrally formed in the housing of an electronic component such as a pager unit. Embodiment 200 has a housing 210 which has a front wall 212, rear wall 214, opposite side walls 216 and 218. A bottom wall 220 and top wall 225 complete the enclosure. A section 228 of the housing enclosure defines a compartment adapted to receive the electronic components of the beeper which are well known and form no part of the invention. A suitable digital display 225 is provided on the upper surface 222. The beeper may be an operational beeper or pager or the housing may simply be a simulated pager having the appearance of an electronic beeper or pager device. The rear wall 214 is provided with a clip 230 for attachment of the device to the belt or top of trousers of the user.

The housing defines a chamber 242 which is configured to receive conventional aerosol canister 10. The chamber includes a seat 244 against which the upper portion of the canister 10 seats. The canister is removably received within the housing by means of access door 250 which is threadably engaged in the housing. A valve stem 18 projects upwardly from valve 12 and engages actuator 260.

The actuator 260 is best seen in FIGS. 5 and 7 and is pivotal about pin 265. A portion of the actuating lever has a knurled surface 270 which projects above the upper surface 222 of the holder. The actuator is normally biased to the non-actuated position shown in FIG. 4 by means of a spring 271 which engages an interior surface 273 of the housing. When the actuating lever is manually actuated by pressing downwardly as shown in FIG. 5, the lower cam surface 262 of the actuator engages and depresses the valve stem 18 of the aerosol canister causing it to release its contents at the discharge nozzle. The discharge nozzle 15 communicates through passage 244 with orifice 245 located in the side of the housing. Thus, the contents of the aerosol canister 10 may be easily directed at a target or assailant.

The actuator 260 may be moved to a safety "off" position by sliding it rightward as viewed in FIG. 4 so that the actuator is restrained from downward movement by the engagement of surface 262 with housing surface 261.

The actuator device shown in FIGS. 4 through 6 is essentially identical to the actuator shown in FIGS. 1 to 3. Both of the embodiments 100 and 200 may be conveniently carried by the user in a pocket or attached to a belt and presents the appearance of a normal electronic device. The electronic device may be an actual operating device or the device may simply have the overall exterior appearance of an operating electronic device. The purpose and object is to contain the aerosol container in an ordinary, common place device thereby not alerting bystanders that the wearer has a deterrent spray on his or her person. Further, by associating the spray canister with a device which may be worn on the belt or trousers, the device is in a ready position for retrieval and actuation if necessary.

FIGS. 8 to 11 illustrate another embodiment of the present device generally designated by the numeral 300 in which the canister 10 is housed within a flashlight. The device of this embodiment includes a generally cylindrical housing 302 having a rear section 304 which has a compartment 306 which receives batteries 308 in conventional fashion. A switch 315 is provided which may be used to selectively connect the battery to the bulb 318 located in the head 320 of the flashlight. Bulb 318 is protected by a conventional lens 322. The flashlight components are of well known conventional design. The housing 302 is modified having an intermediate section 328 which defines a compartment 330 which is dimensioned to receive a cartridge 10 containing a deterrent spray. The cartridge is of the type described above having a dispensing valve 12 terminating at a discharge nozzle 15 which in this case is axially oriented. Access to chamber 328 is by means of removable door or panel 332.

Figure 8:
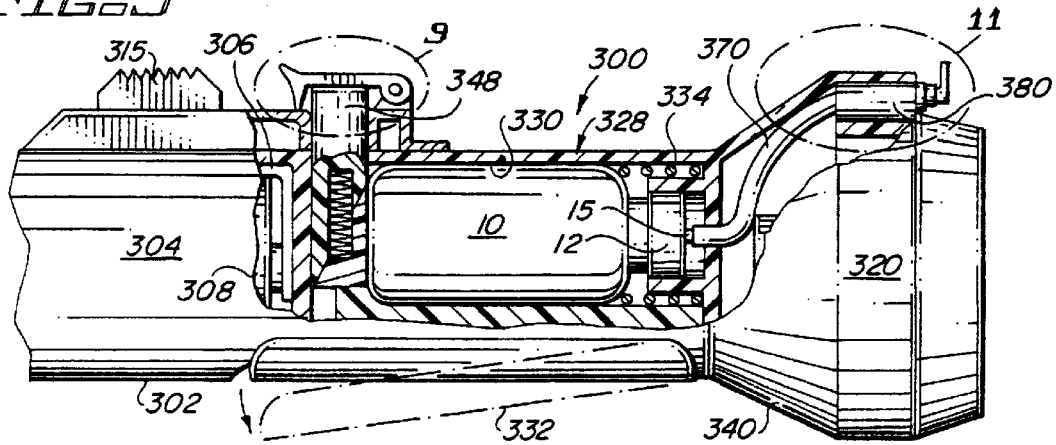
FIG. 8 is a view partly broken away showing a flashlight having a chamber for receiving an aerosol canister.
Figure 9:
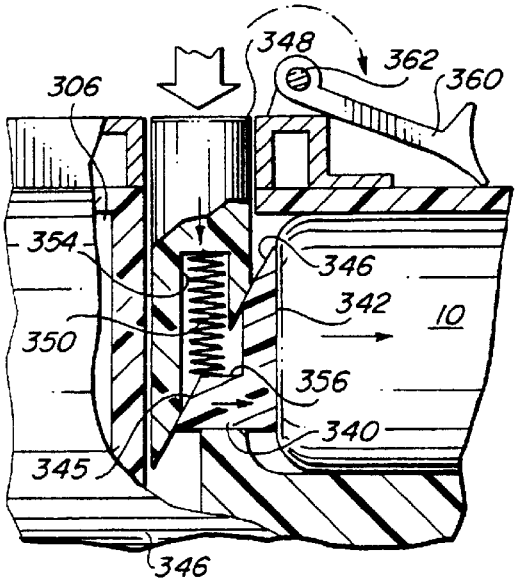
FIG. 9 is an enlarged detail view as indicated in FIG. 8.

With the cartridge 10 in place, the forward end of the cartridge is engaged by spring 334 which applies a rearwardly biasing force to the canister. The rear end of the canister engages an actuator assembly which includes a first wedge member 340 having a surface 342 which, as best seen in FIG. 9, engages the rear end of the cartridge. The member 340 has an angular surface 345 which is in engagement with a similarly angled surface 346 of actuator pin 348. Actuator pin 348 is biased upwardly by spring 350 received within recesses 354 and 356 in members 348 and 340, respectively. As shown in FIG. 9, it will be appreciated that downward manual pressure on actuator pin 348 will cause member 342 to be displaced rightwardly resulting in actuating force being applied to the valve 12 at the end of the container 10. In order to prevent inadvertent actuation of the device, a safety lever 360 is pivotally secured to the exterior of the housing at axle 362. The safety lever is shown in the normal "on" position in FIG. 8 and in order to actuate the device, the lever 360 must be rotated to the safety "off" position shown in FIG. 9 exposing the actuating pin 348.

Figure 10:
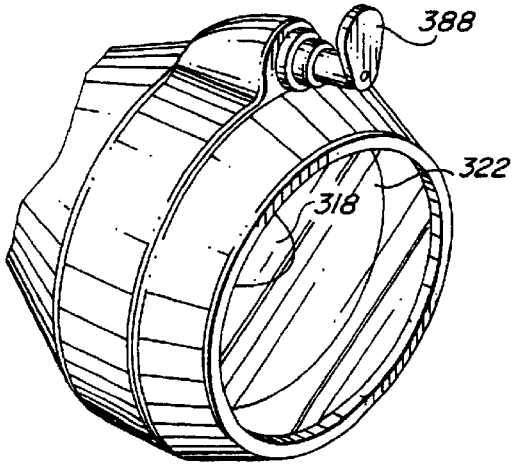
FIG. 10 is a perspective view of the head of the flashlight assembly as shown in FIGS. 8 and 9.
Figure 11:
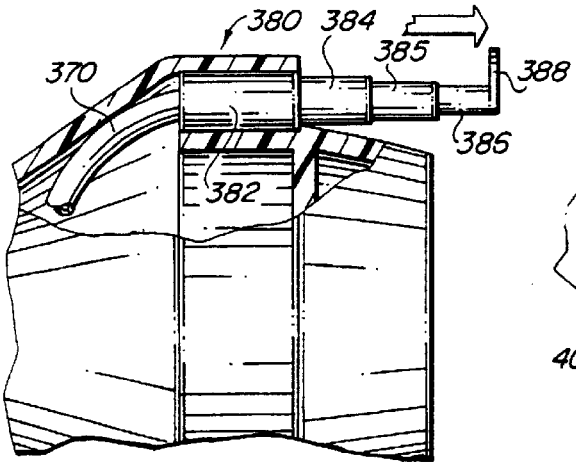
FIG. 11 is an enlarged detail view as indicated in FIG. 8.

A flexible conduit 370 is connected to the discharge nozzle 15 and communicates with discharge assembly 380. Discharge assembly 380 is best shown in FIGS. 10 and 11 and includes a plurality of telescoping sections 384, 385, and 386 which may be extended, as shown in FIG. 11, or retracted as shown in FIG. 8. A projection 388 is attached to the outer-most nozzle section 386 to facilitate manual extension and retraction of the telescoping nozzle assembly. The nozzle assembly is shown as positioned on the exterior of the head portion of the flashlight generally axially aligned with the beam of light emanating from bulb 318.

Thus, to use the device, the safety lever 360 is pivoted open and telescoping nozzle 388 extended to the position shown in FIG. 11. The user can direct the light beam to the desired location and if it is necessary to release a deterrent spray, pin 380 is pushed downward causing the spray to be discharged at nozzle assembly 380. Since the light beam and discharge nozzle are oriented in the same direction, potential targets may be illuminated and accuracy of the dispensed spray is increased.

Figure 12:
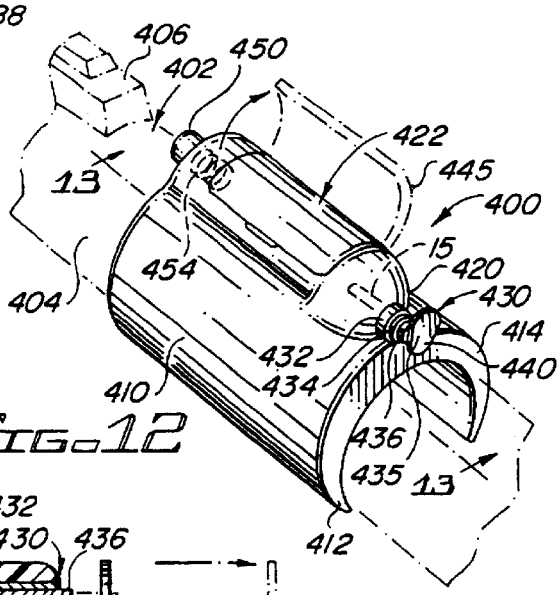
FIG. 12 is a perspective view of an alternate embodiment of a holder which may be attachably secured to a conventional flashlight.
Figure 13:
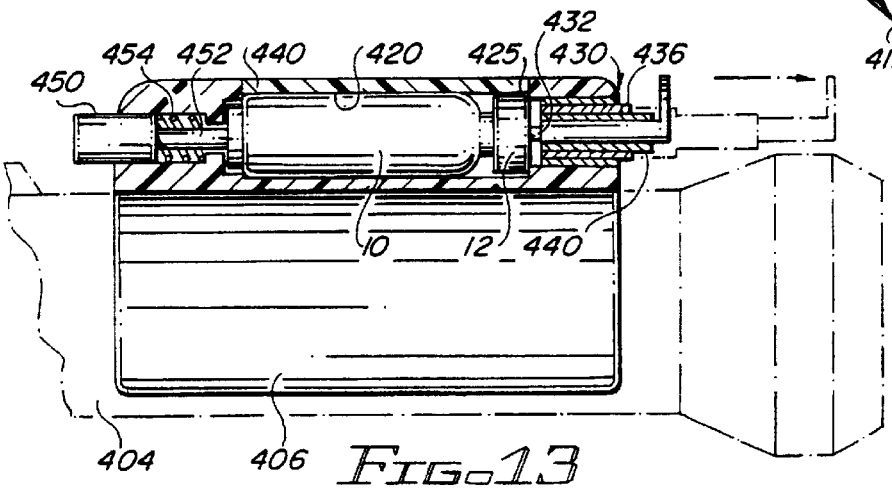
FIG. 13 is a sectional view taken along line 13—13 of FIG. 12.

FIGS. 12 and 13 show still another embodiment of the present invention generally designated by the numeral 400. In this embodiment, the holder is adapted to be detachably secured to a conventional flashlight 402 having a generally cylindrical housing 404. The flashlight is actuated at switch member 406. The remainder of the flashlight construction is not shown or described since its construction and operation is conventional and well known. The embodiment shown in FIGS. 12 and 13 can be made in various size and can be adapted to attach to other objects such as the barrel of a handgun of the type shown in FIG. 27.

The holder 400 has a body formed as an elongate generally semi-circular clip 410 having opposite arcuate arms 412 and 414 which will frictionally engage the exterior of the cylindrical flashlight body 404. The clip 410 carries a housing 420 which defines a generally elongate chamber 422 that receives conventional spray canister 10 of the type described above. The forward end of the cartridge engages a seating surface with the axially projecting nozzle 15 discharging into telescoping nozzle assembly 430. The nozzle assembly 430 is similar in construction to that described with respect to FIG. 11 having a fixed section 432 and telescoping sections 434 and 436 which define a central discharge passageway 440 through which the aerosol spray is discharged. The nozzle assembly may be manually extended to the position shown in dotted lines in FIG. 13 by exerting an extension force to projection 435. Access to the housing 422 is by means of removable access door 445 which facilitates replacement of the cartridge when necessary. The cartridge is actuated by applying manual pressure to actuator button 450 which applies a rightward force to the rear of the cartridge. The actuating button 450 is normally biased to a non-actuated position by spring 454.

As shown in FIG. 13, rightward depression of actuating button 450 will move the container 10 rightward actuating the discharge valve 12 on the cartridge. The advantage of the holder of embodiment 400 is that it may be conveniently attached or removed to flashlights of conventional design. When attached, the telescoping nozzle 430 may be extended to emit a spray in the direction of the light beam from the flashlight so that the light beam clearly illuminates the intended target.

Figure 15:
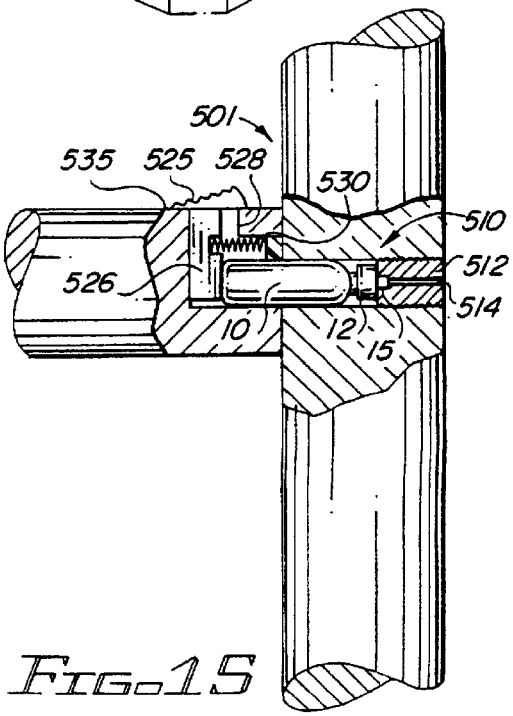
FIG. 15 is an enlarged detail view as indicated in FIG. 14.
Figure 16:
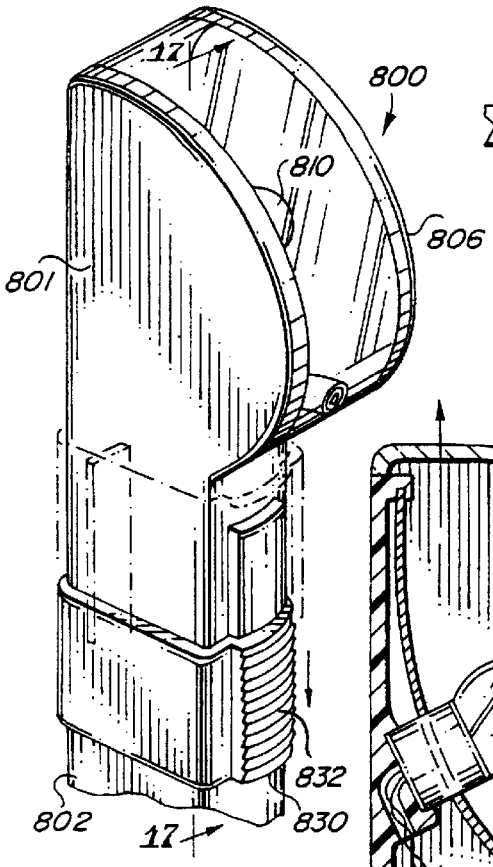
FIG. 16 is a perspective view of a portion of a flashlight having provision for receipt of an aerosol canister.
Figure 14:
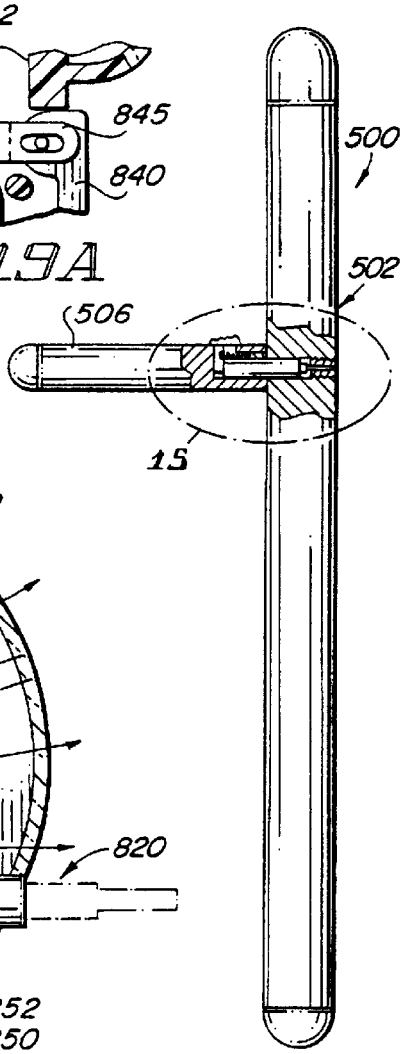
FIG. 14 illustrate an alternate embodiment of the present invention in which the aerosol canister is contained within a police-type baton.
Figure 17:
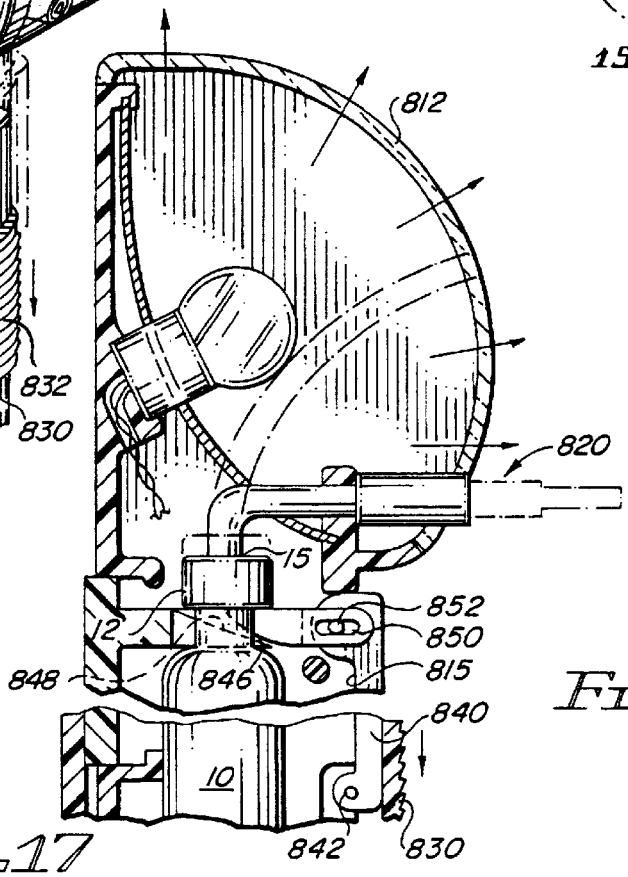
FIG. 17 is a sectional view taken along line 17—17 of FIG. 16.
Figure 18:
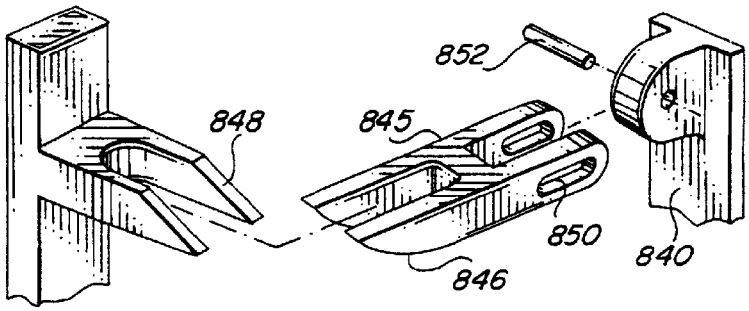
FIG. 18 is an exploded perspective view illustrating the actuator of the device shown in FIGS. 16 and 17.

FIGS. 14 and 15 show another embodiment of the present invention generally designated by the numeral 500. In this embodiment, a law enforcement baton 501 is shown having a generally elongate tubular body 502. A handle 506 extends transversely from the body 502 at a location disposed approximately one-third from the upper end of the baton. In normal use, the law officer grasps the handle 506 allowing the officer to rotate the body 502 in order to deliver a blow or to provide protection against a blow or an object directed at the officer.

In some instances, it may be desirable for the officer to be able to dispense a chemical deterrent spray and accordingly the baton has been modified to include a generally cylindrical chamber 510 axially aligned with the axis of handle 506. The chamber opens to the exterior of the body 502. The chamber is accessed by a threaded plug 512 which defines a centrally extending nozzle 514. The aerosol canister 10 is received within the chamber 510 with the discharge nozzle 15 of the container abutting and aligned with the discharge passageway 514. An actuator switch 525 has a depending leg 526 extending within transversely extending opening 528. Leg 526 is biased leftwardly as seen in FIG. 15 by spring 530. The upper end of leg 526 terminates at a slide switch 535. The upper surface of the slide switch 525 is knurled for better frictional engagement with the finger or thumb of the user. In use, the spray-containing canister 10 is inserted into the chamber 510 and plug 512 placed in threaded engagement in the baton. In this position, the cartridge is in a non-actuated position with the discharge valve 12 of the canister aligned with the discharge passageway 514.

In use, the baton is used in conventional manner. If the user wishes to discharge a deterrent spray, the slide switch 525 is moved rightwardly as shown in FIG. 15 which will depress the discharge valve 12 discharging the contents through passage 514.

FIGS. 16 through 20 show another embodiment of the present invention generally designated by the numeral 800 which is shown having a generally rectangular body 802 which contains a battery and the electrical components of the flashlight. The head end of the flashlight is defined by opposite generally semicircular side walls 804 and 806 which house a bulb 810 therein. An arcuate lens 812 protects the bulb.

The upper end of housing 802 defines a chamber 815 which receives the spray canister 10. As has been set forth previously, the cartridge has a valve 12 which is actuated to release the contents of the container. The nozzle 15 of valve 12 is connected to telescopic discharge assembly 820 which extends through the lens 812 at a location adjacent the bulb. Telescopic sections 821 and 822 can be manually extended to the position shown in FIG. 20 if desired. Alternately, the canister may be connected to a flexible conduit extending through the head of the flashlight and discharging at a location generally aligned with the bulb as shown in dotted lines in FIG. 17.

Figure 19A:
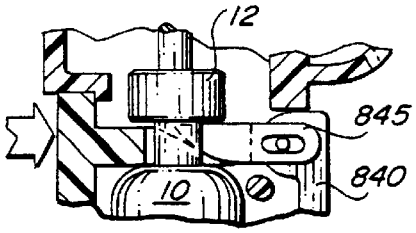
FIGS. 19A through 19C show the sequential steps in the actuation of an aerosol canister containing the device of FIGS. 16 and 17.
Figure 19B:
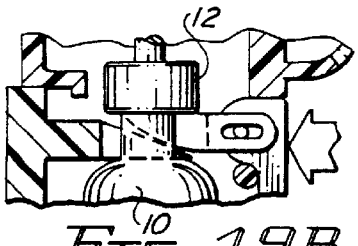
Figure 20:
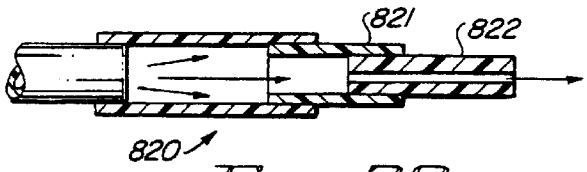
FIG. 20 is a detail view, partly in section, of the extensible discharge nozzle of the device shown in FIGS. 16 and 17.
Figure 19C:
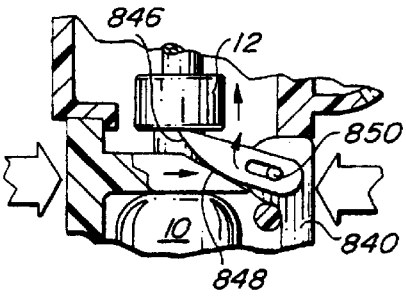
Figure 25:
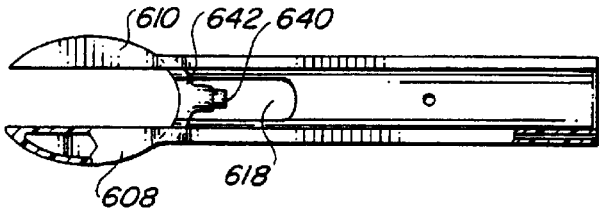
FIG. 25 is a top view of the attachment assembly shown in FIG. 23.
Figure 24:
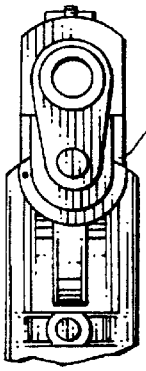
FIG. 24 is a front view looking from the barrel end of the device of FIG. 23.

The valve of the canister 10 is actuated by means of sleeve 830 which is axially slidable along the housing 802. Sleeve 830 has a knurled section 832 against which the user's thumb would normally rest to move the slide to the actuated position. The non-actuated position is shown in solid lines in FIG. 16 and the forward actuated position is shown in dotted lines. When the slide 830 is moved upwardly, the slide will move along the outer surface of pivotal arm 840. Arm 840 is pivotal about pivot point 842. A link 845 has a cam surface 846 which engages fixed cam surface 848 which extends around or beneath the valve of the cartridge. Link 845 has an elongate aperture 850 which receives the oppositely extending ends of pin 852 on the pivotal arm 840. As seen in FIGS. 19A, 19B and 19C, upward movement of the slide 830 will move the pivotal arm inwardly causing the cam surfaces 846 and 848 to engage. As engagement occurs, the pivot link 845 will engage the valve 12 moving it upwardly as shown in FIG. 19C, thus discharging the contents of the container. Note that various configurations of the canister are available and one must be selected that is operationally consistent with the embodiment of the invention described.

Figure 22:
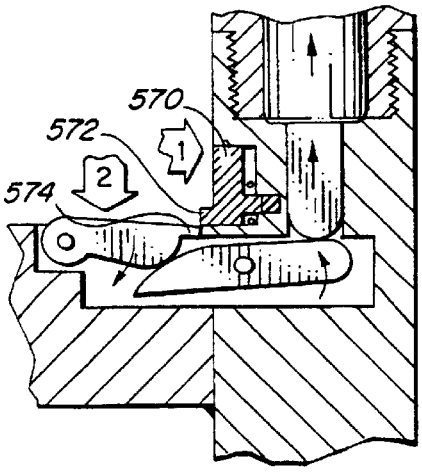
FIG. 22 is a detail view showing the actuation of a canister contained within the device of FIG. 21.
Figure 21:
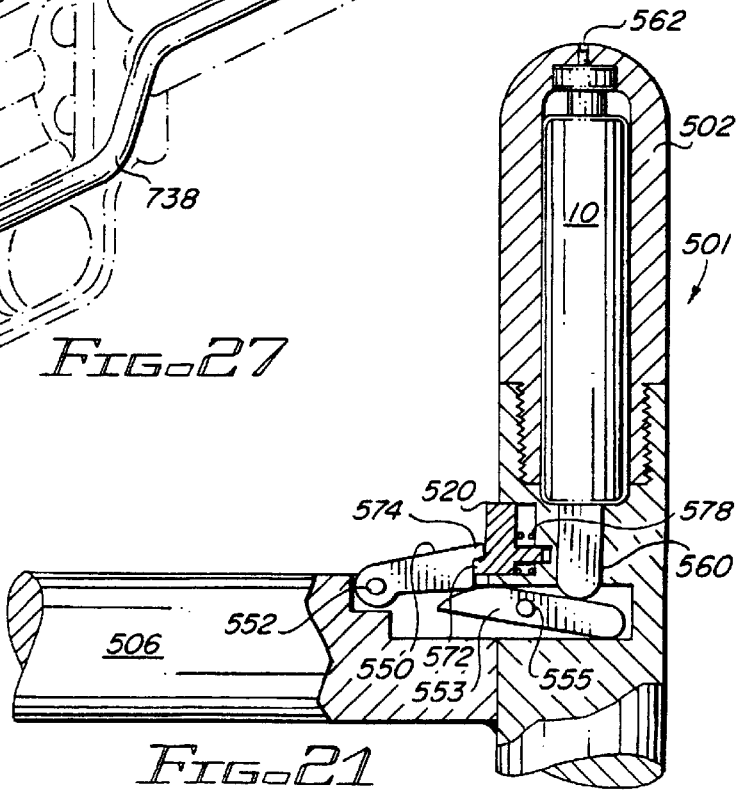
FIG. 21 is a partial sectional view of a portion of a police baton showing another housing and actuator arrangement for an aerosol defense spray canister.
Figure 26:
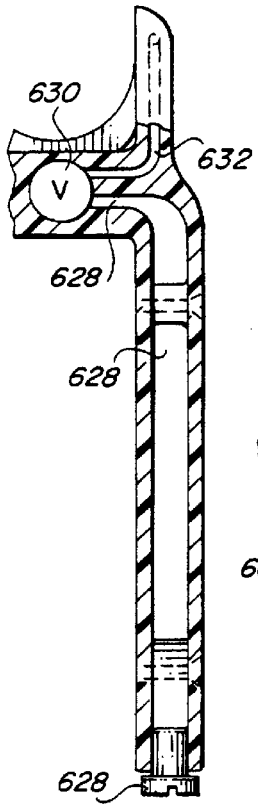
FIG. 26 is a sectional view taken along line 26—26 of FIG. 23.

FIGS. 21 and 22 show a modified form of actuator for an aerosol container which may be incorporated in a baton of the type shown in FIGS. 14 and 15. The baton 501 as described above with reference to the aforementioned previous drawing figures has a handle 506 and body 502 as has been described. The actuator of this embodiment has an actuating lever 550 which is pivotal about pivot point 552 disposed near the juncture of the baton body 502 and baton handle 506. Downward movement of the lever 550 will pivot cam link 553 about its pivot point 555. As the left end of the cam link 553 moves downwardly, the opposite end will rotate upwardly against pin 560 applying an upward, actuating force to the underside of the canister 10 emitting a discharge spray at opening 562 at the end of body 502.

Inadvertent discharge of the spray cartridge is prevented by safety lock 570. Safety lock 570 has a flange 572 which normally engages a cooperating lip 574 on lever 550. In the locked position, shown in FIG. 21, downward or actuating movement of actuator lever 550 is prevented by lever 550. When safety lock 570 is pushed rightwardly against biasing spring 578, lever 550 is released allowing it to descend into engagement with cam link 555. The sequence of operation is indicated by arrows 1 and 2 in FIG. 22.

Figure 23:
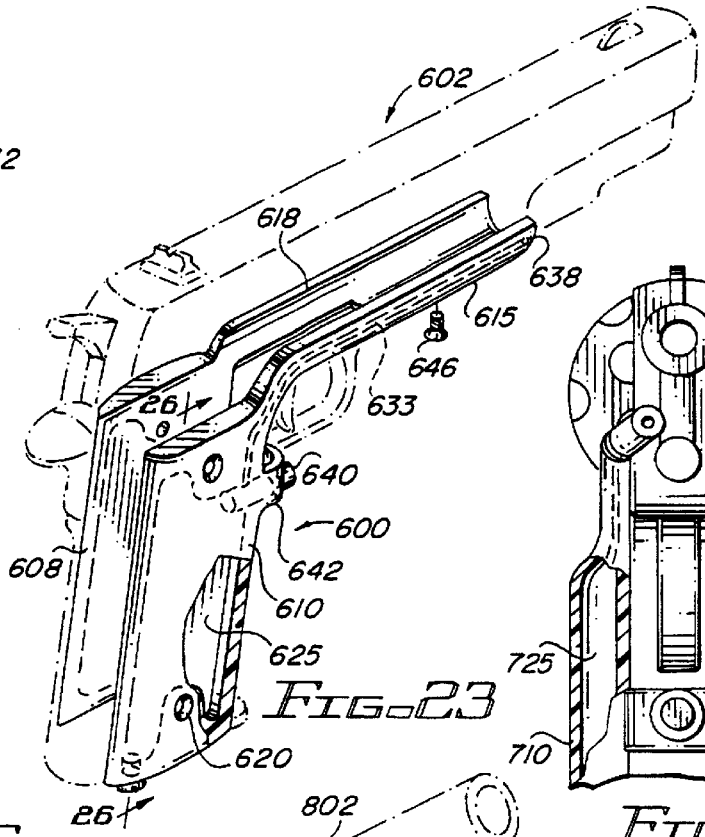
FIG. 23 is a perspective view showing a deterrent spray housed within a grip adapted to be attached to a firearm such as an automatic pistol, the pistol being shown in phantom lines.

FIGS. 23 through 26 show still another embodiment of the present invention generally designated by the numeral 600. The holder 600 is for a defense spray adapted to be used in conjunction with a conventional firearm such as automatic handgun 602, shown in dotted lines. The holder 600 includes a pair of spaced-apart grip-like housing members 608 and 610 configured to be positioned against the handle portion of the frame of the handgun 602 having the general appearance and shape of conventional grips. The housing members 608 and 610 are interconnected by a generally U-shaped frame 615 having an aperture 618 to receive the trigger and guard assembly of the pistol. Thus, the holder 600 can be positioned on the frame of a conventional firearm as shown in FIG. 23 and secured in place by suitable screws in holes 620 in the holders.

One or both of the housing members 608 and 610 define a hollow interior chamber 625 having a removable plug 628 at the lower end. In this way, the chamber 625 can be charged with a suitable pressurized deterrent chemical. The upper end of chambers 625 communicate via conduit 628 with a valve 630. The discharge from valve 630 extends via passageway 632 and conduit 633 along the underside of frame 615 terminating at discharge aperture 638 located forwardly along the underside of the barrel of the handgun. The valve 630 may be operated by pressing actuator button 640 which is located on a bridge member 642 extending between the housing members 608 and 610 beneath the trigger guard. The holder 600 can be easily secured to a conventional handgun as shown. Screws 620 and 646 may be necessary. Once secured to the handgun, the user will grip the handgun in conventional fashion. If the user wishes to discharge the nonlethal defense spray, button 640 is pushed using either the trigger finger or the second finger which is disposed about the grip or housing members 608 and 610.

The deterrent spray holder can be removed from the weapon when it is not required. The holder does not otherwise interfere with the normal operation of the weapon and the defense spray would be directed against the target in the normal manner of aiming the weapon. The user's first finger can remain within the trigger guard so the weapon can be fired if necessary.

Figure 27:
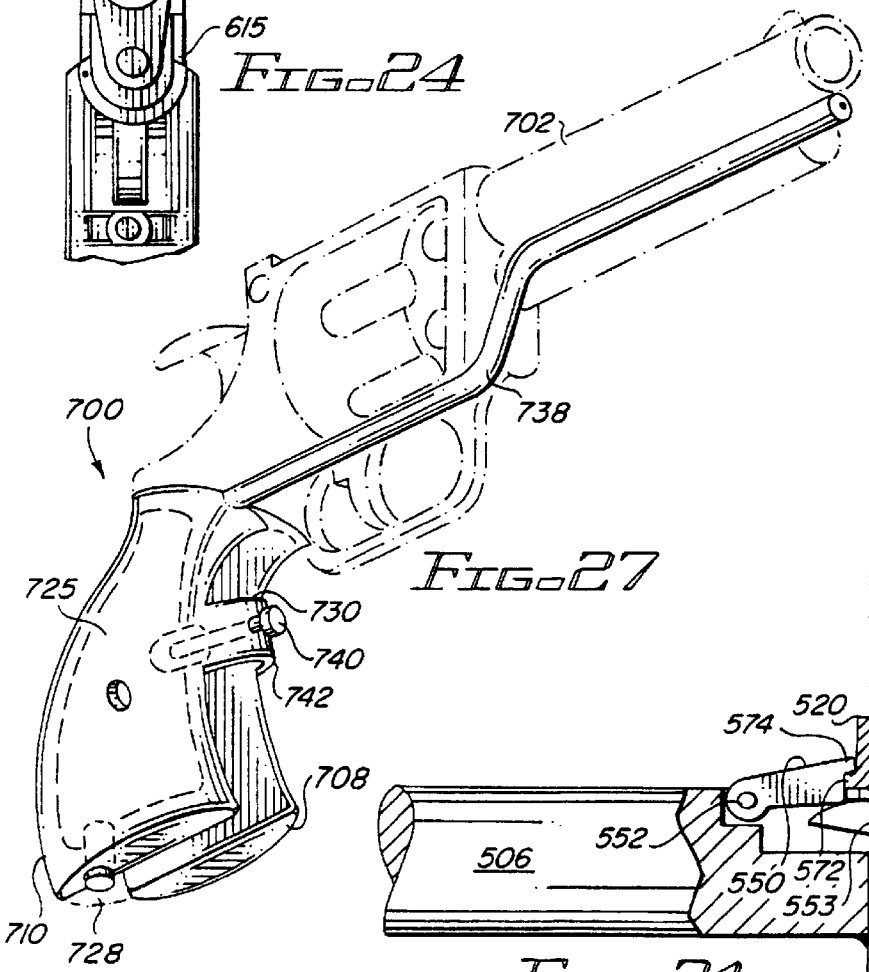
FIG. 27 is a perspective view of another embodiment of the present invention in which the deterrent spray is contained within grips of a handgun shown as a revolver.
Figure 28:
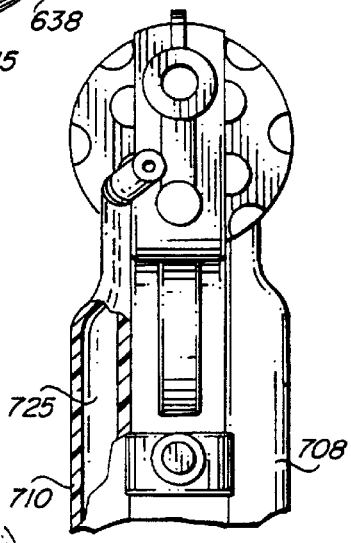
FIG. 28 is a view looking from the barrel end of the device shown in FIG. 27.
Figure 29:
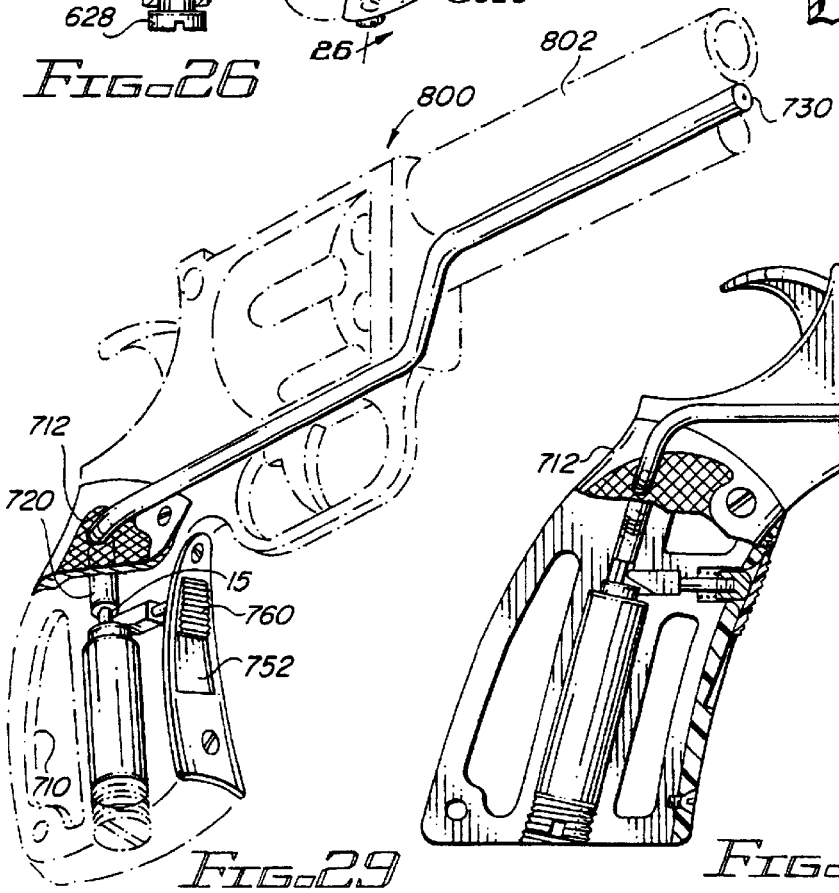
FIG. 29 is a perspective view illustrating a handgun having a chamber in the grip adapted to receive an aerosol canister.
Figure 30:
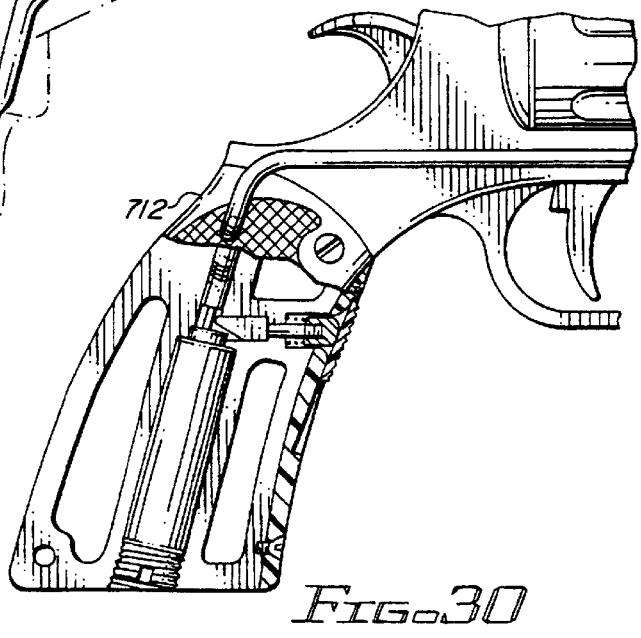
FIG. 30 is a side view of a portion of the handgun shown in FIG. 29, partially broken away to show the actuator.

FIGS. 27 and 28 show slightly modified form of the a holder for use in connection with a handgun. The holder shown in these figures is generally designated by the numeral 700 and is shown in connection with a handgun of the revolver type indicated by the numeral 702. The revolver 702 is shown in dotted lines. The construction of the holder is similar to that shown in FIGS. 24 through 26 having a pair of chambers 708 and 710 generally configured to conform to the shape of grips normally associated with firearms of this type. At least one of the grip-like members, as for example member 710, defines an interior chamber 725 which is closed by plug 728. The chamber 725 is adapted to receive a supply of pressurized aerosol defense spray. The grip members are interconnected by U-shaped bridge 742. The chambers communicate across discharge valve 730 with a conduit 738 which extends along the frame of the firearm terminating at the underside of the barrel. The aerosol spray is released by depressing actuator 740 located on the bridge 742 interconnecting the grip components.

The holder may be fabricated from any suitable material such as plastic and conduit 738 may be plastic and may be pre-formed to fit the particular model of handgun. The conduit 738 may be suitably flexible so that it may be shaped when attached to conform to the physical configuration of the firearm. The holder does not interfere with the normal use of the firearm and allows the user the option of first discharging a non-lethal defense spray prior to or instead of discharging a potentially deadly bullet.

FIGS. 29 through 32 show still another embodiment of the present invention generally designated by the numeral 800. In this embodiment, an aerosol defense spray is adapted to be contained within the modified frame of firearms such as pistol 802. Pistol 802 is shown as a revolver and normally the handle frame is hollow providing a chamber 710 in which an aerosol canister 10 is inserted by removal of grip 712. The discharge nozzle 15 of the spray canister is received within end 720 of conduit 725. Conduit 725 extends along the frame of the handgun terminating at a discharge nozzle 730 at a location on the underside of the barrel adjacent the end.

The aerosol is released by depressing actuator button 750 inwardly as shown in FIG. 31C. The button 750 is biased outwardly and has a stem 732 slidingly received within the handle. The stem 732 terminates at a cam 734 having a cam surface 735 which engages the valve portion of the canister. The cam surface, when moved leftwardly as shown in FIG. 31C, will cause the valve 12 to be depressed releasing the aerosol contents into the conduit 725 from where it is discharged at nozzle 730.

A safety device is provided to prevent the inadvertent actuation of the gas. The safety is shown as a slide switch 760 slidable within a recess 752 in the forward portion of the handle frame. With the slide 760 in the position shown in FIG. 31A, the actuating button 750 is not accessible. If it is desired to release the contents of the canister, the slide switch is moved downwardly as shown in FIG. 31B exposing the actuator button 730.

The handgun can be used in normal fashion and it is a relatively simple matter for a user when holding the handgun in the normal fashion to move the safety switch 760 to the unlocked position to permit actuation of the spray-containing canister.

Figure 33:
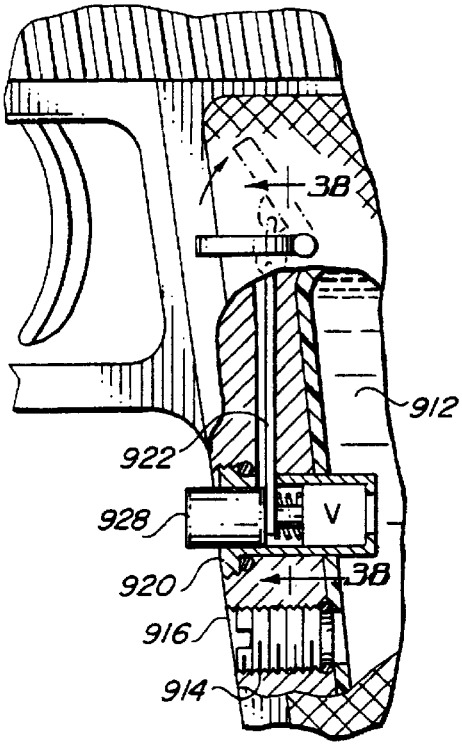
FIG. 33 is a detail view partly broken away of a portion of the frame of the handgun shown in FIG. 32.
Figure 35:
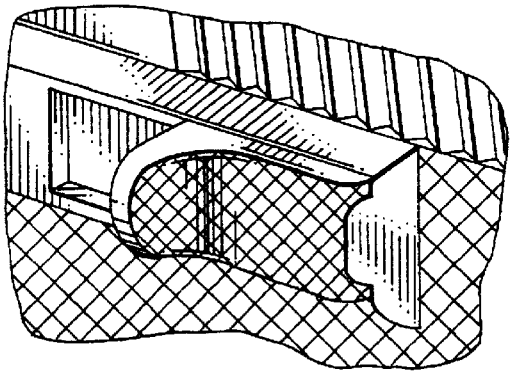
FIG. 35 is a detail view of an alternate safety slide for a handgun such as is shown in FIG. 32 with a safety being shown in a closed blocking position.
Figure 36:
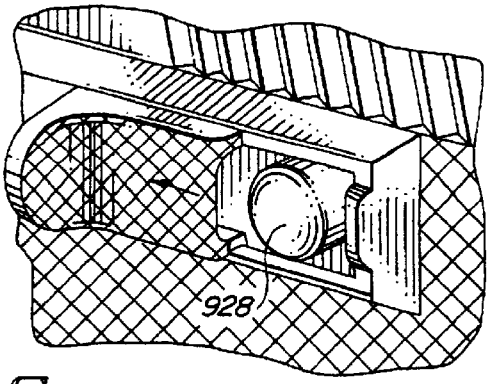
FIG. 36 is a view similar to FIG. 35 showing the safety in an "off" or non-blocking position.

FIGS. 33 to 35 show still another embodiment of the present invention which is generally designated by the numeral 900. In this embodiment, an aerosol defense spray is contained within the frame of a firearm such as automatic pistol 902. The pistol 902 has a conventional frame with a handle 910. The handle 910 receives a clip within a clip holder in the handle, not shown since this is conventional design. A portion of the handle defines an interior reservoir 912 to which access may be obtained by means of port 914. Port 914 receives a removable plug 916 which may be removed in order to fill the reservoir 912 with a suitable deterrent chemical under pressure. A valve 920 communicates with the reservoir and when opened will communicate the contents of the reservoir 912 with conduit 922. Conduit 922 extends within the handle longitudinally along the underside of the barrel terminating at discharge nozzle 925 adjacent the end of the barrel of the pistol. In this way, a user aiming the pistol in the normal fashion will direct the discharge nozzle toward an intended target. Valve actuator 928 is shown in the form of a button positioned on the inner surface of the handle below the trigger guard. When the button is depressed, the valve is opened to release the contents of reservoir 912 into discharge conduit 922.

Figure 37:
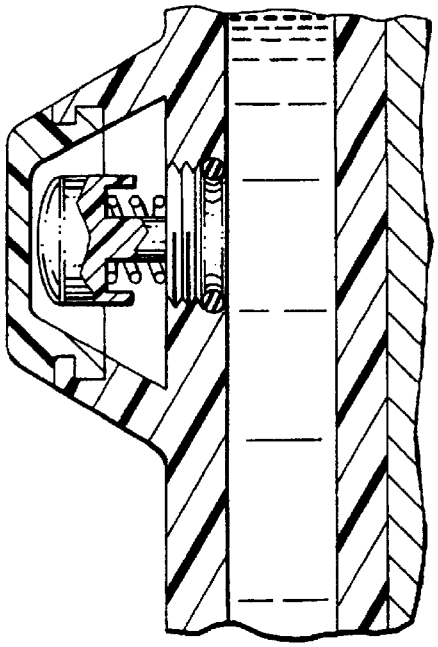
FIG. 37 is a detail sectional view showing the safety slide of FIGS. 35 and 36.

The handgun is shown with a conventional standard safety 950 which when in the "on" position, prevents the weapon from being fired. In addition, a second safety switch 930 is shown positioned on the upper portion of the grip rearward of the trigger. As best seen in FIG. 34, the safety switch includes a lever 932 which is connected to a pin 934 which is rotatively supported in the handle transversely of the handle. Pin 934 is attached to a stop 936 by means of link 935. The stop 936 has a lower end which defines an arcuate recess 940. When the safety is in the "on" position as shown in FIG. 37, the stop 936 is rotated to a position abutting the rear of actuator button 928. In this position, rearward movement of the button is restricted. When safety lever 930 is rotated upwardly as indicated by the arrow in 36, pin 934 will rotate lifting the stop bar 936 from its obstructing position. With the safety in the "off" position, button 928 may be depressed rearwardly actuating valve 920 releasing deterrent spray.

In the form of the invention shown in FIGS. 32 to 34, a conventional handgun is modified to include the components of the deterrent spray system which modification would normally be done by the original equipment manufacturer.

FIGS. 35 to 40 show an alternate safety arrangement for a handgun as shown in FIG. 32 having deterrent spray capability. In this embodiment, a surface of the grip is again provided with a button 928 which when depressed will release the deterrent spray from the reservoir within the frame of the handgun. The safety is in the form of a safety slide switch 950 which is laterally slidable with respect to housing 952. The switch 950 has a flange 954 which is slidably received in a pair of oppositely extending transverse grooves 956 located adjacent the upper edge of the housing. The slide has a raised end 960 which may be engaged by the thumb of the user to move the switch from between the open and closed positions. In the closed position shown in FIG. 35, the actuator button is obstructed. In the open position shown in FIG. 36, the safety slide has been moved leftward to expose the actuator button so that the user may discharge the contents of the deterrent spray reservoir.

While the principles of the invention have been made clear in the illustrative embodiments set forth above, it will be obvious to those skilled in the art to make various modifications to the structure, arrangement, proportion, elements, materials and components used in the practice of the invention. To the extent that these various modifications do not depart from the spirit and scope of the appended claims, they are intended to be encompassed therein.

I claim:

1. A holder for an aerosol defense spray for use in connection with a handgun of the type having a frame with an elongate barrel, a handle and a trigger, said holder comprising:

(a) grip means securable to the handle of said handgun frame, said grip means defining a reservoir for containing a defense spray;

(b) conduit means having one end communicating with said reservoir and a discharge end at a location at the end of the barrel, said conduit extending alone and exteriorly of said barrel;

(c) actuator means for selectively controlling the discharge of aerosol spray into said conduit; and (d) safety means moveable from an "on" position blocking said actuator means to an "off" position permitting operation of said actuator means.

2. The device of claim 1 wherein said discharge means includes a button positioned on the front side of said grip means.

3. A handgun of the type having a frame having a grip and with an elongate barrel and a trigger, said handgun further comprising:

(a) a compartment defined by said frame for receiving an aerosol cartridge of the type having a valve actuated nozzle;

(b) conduit means having one end communicating with said nozzle and extending exteriorly along said barrel with the discharge end located at a position aligned with the said barrel;

(c) actuator means on said frame for selectively actuating said valve to cause an aerosol spray to be emitted at said conduit discharge end; and (d) safety means moveable from an "on" position blocking said actuator means to an "off" position permitting operating of said actuator means.

* * * * *